US008092088B2

(12) United States Patent
Keith et al.

(10) Patent No.: US 8,092,088 B2
(45) **Date of Patent: *Jan. 10, 2012**

(54) EXTENDED LIP WICKET SLIDER DELI BAG

(75) Inventors: David W. Keith, Shelbyville, IN (US); Paul F. Edelman, Greenwood, IN (US)

(73) Assignee: Illinois Tool Works Inc., Glenview, IL (US)

( * ) Notice: Subject to any disclaimer, the term of this patent is extended or adjusted under 35 U.S.C. 154(b) by 716 days.

This patent is subject to a terminal disclaimer.

(21) Appl. No.: 11/465,969

(22) Filed: Aug. 21, 2006

(65) Prior Publication Data

US 2007/0047850 A1 Mar. 1, 2007

Related U.S. Application Data

(63) Continuation of application No. 10/107,694, filed on Mar. 27, 2002, now Pat. No. 7,097,358.

(51) Int. Cl.

| | |
|---|---|
| ***B65D 30/00*** | (2006.01) |
| ***B65D 33/10*** | (2006.01) |
| ***B65D 33/06*** | (2006.01) |
| ***B65D 33/16*** | (2006.01) |

(52) U.S. Cl. ..... 383/37; 383/9; 383/13; 383/64

(58) Field of Classification Search ..... 383/9, 37, 383/67, 7, 13, 64

See application file for complete search history.

(56) References Cited

U.S. PATENT DOCUMENTS

| | | | |
|---|---|---|---|
| 4,094,729 | A | 6/1978 | Boccia |
| 4,534,752 | A | 8/1985 | Ferrell et al. |
| 4,734,148 | A | 3/1988 | Meyer |
| 4,736,450 | A | 4/1988 | Van Erden et al. |
| 5,094,707 | A | 3/1992 | Bruno |
| 5,129,734 | A | 7/1992 | Van Erden |
| 5,419,437 | A | 5/1995 | Huseman |
| 5,575,393 | A | 11/1996 | Gebhardt |
| 5,682,730 | A | 11/1997 | Dobreski |
| 5,692,837 | A | 12/1997 | Beer |
| 5,772,070 | A | 6/1998 | Hayes et al. |
| 5,788,080 | A | 8/1998 | Sill et al. |
| 5,862,944 | A | 1/1999 | Scherr |
| 5,908,245 | A | 6/1999 | Bost et al. |
| 5,938,337 | A | 8/1999 | Provan et al. |
| 5,971,155 | A | 10/1999 | Liang |
| 6,007,244 | A | 12/1999 | Dinder |
| 6,164,826 | A | 12/2000 | Petkovsek |
| 6,257,763 | B1 | 7/2001 | Stolmeier et al. |
| 6,264,035 | B1 | 7/2001 | Petrie |
| 6,286,999 | B1 | 9/2001 | Cappel et al. |
| 6,293,701 | B1 | 9/2001 | Tomic |
| 6,293,896 | B1 | 9/2001 | Buchman |

(Continued)

FOREIGN PATENT DOCUMENTS

WO 9813271 4/1998

*Primary Examiner* — Jes F Pascua

(74) *Attorney, Agent, or Firm* — John V. Daniluck; Bingham McHale LLP

(57) ABSTRACT

A flexible reclosable container with a header strip, fastener elements, and a slider. The header strip preferably extends from the mouth of the bag, and includes a line of weakness for easy tear off of the bag. The slider and profiles are arranged such that the mouth of the bag is substantially open.

13 Claims, 5 Drawing Sheets

U.S. PATENT DOCUMENTS

| | | | | |
|---|---|---|---|---|
| D451,378 | S | 12/2001 | Kinigakis et al. | |
| 6,325,543 | B1 | 12/2001 | Ausnit | |
| 6,327,754 | B1 | 12/2001 | Belmont et al. | |
| 6,361,209 | B1 | 3/2002 | LaRue et al. | |
| 6,488,410 | B2 | 12/2002 | Schneider | |
| 6,536,951 | B1 | 3/2003 | Sill | |
| 6,712,510 | B2 | 3/2004 | Schneider et al. | |
| 6,880,973 | B2 | 4/2005 | Schneider et al. | |
| 7,036,987 | B2 * | 5/2006 | Crunkleton et al. | 383/64 |
| 7,056,022 | B2 * | 6/2006 | Linton et al. | 383/64 |
| 7,097,358 | B2 * | 8/2006 | Keith et al. | 383/37 |
| 7,134,788 | B2 * | 11/2006 | Hsiang | 383/64 |
| 7,165,886 | B2 * | 1/2007 | Linton et al. | 383/64 |
| 7,251,864 | B2 | 8/2007 | Chang | |
| 2001/0017947 | A1 | 8/2001 | Strand et al. | |
| 2001/0017950 | A1 | 8/2001 | Strand et al. | |
| 2002/0094138 | A1 * | 7/2002 | Schneider | 383/5 |
| 2003/0059129 | A1 * | 3/2003 | Sill | 383/9 |
| 2003/0077007 | A1 | 4/2003 | Turvey et al. | |
| 2003/0185468 | A1 * | 10/2003 | Keith et al. | 383/9 |
| 2003/0210836 | A1 * | 11/2003 | Strand | 383/9 |
| 2004/0161170 | A1 * | 8/2004 | Linton et al. | 383/64 |
| 2004/0161171 | A1 * | 8/2004 | Linton et al. | 383/64 |
| 2004/0161172 | A1 | 8/2004 | Crunkleton et al. | |
| 2004/0252914 | A1 | 12/2004 | Hsiang | |

* cited by examiner

EXTENDED LIP WICKET SLIDER DELI BAG

CROSS-REFERENCE TO RELATED APPLICATIONS

This application is a Continuation of U.S. application Ser. No. 10/107,694, filed Mar. 27, 2002, now U.S. Pat. No. 7,097,358.

FIELD OF THE INVENTION

The present invention pertains to flexible reclosable containers and in particular to flexible reclosable containers with sliders and tear off header strips. The present invention also pertains to other containers, including containers sold to consumers in the empty state, as well as containers sold to consumers after being formed, filled, and sealed with a product contained therein.

BACKGROUND OF THE INVENTION

Flexible recloseable containers are provided in some applications where a plurality of containers are mounted together in such a way that the containers are separated from one another as they are used. Examples of this include containers provided in a supermarket for use by a store employee in the meat department. As the employee receives an order for food, a container is separated from the group of containers, and filled with the product to be sold.

It is important in such a retail situation to minimize the time required by the employee to serve the customer. Therefore, bags that are provided to the employee in an upside-down orientation require wasted effort on the part of the employee to reorient the bag. Further, containers that are provided in the closed state must be opened prior to the insertion of the goods. This further wastes the time of the employee.

What is needed is a flexible recloseable container that overcomes these problems. The present invention does this in a novel and unobvious way.

SUMMARY OF THE INVENTION

The present invention relates to flexible recloseable containers, especially those containers which are grouped together and separated singularly from the group.

In one aspect of the present invention, each container includes a header sheet extending from one edge of the container, the header sheet including a line of weakness to facilitate a tearing separation.

According to another aspect of the present invention, a header sheet including a line of weakness extends from the top of the bag, the bottom of the bag, or one of the sides of the bag.

In yet another aspect of the present invention, the container includes a pair of fastener strips which can be repeatedly interlocked and unlocked to open and close, respectively, the mouth of the bag.

In yet another aspect of the present invention, the fastener profiles include a slider element for ease of interlocking and unlocking. Preferably, the bags are grouped with the sliders positioned so that the mouth of the container is at least partially open.

Yet another aspect of the present invention concerns a method for fabrication of a flexible reclosable container having a header strip.

These and other embodiments of the present invention will be apparent from the drawings, description of preferred embodiments, and the claims to follow.

DESCRIPTION OF THE PREFERRED EMBODIMENTS

Figure 1:
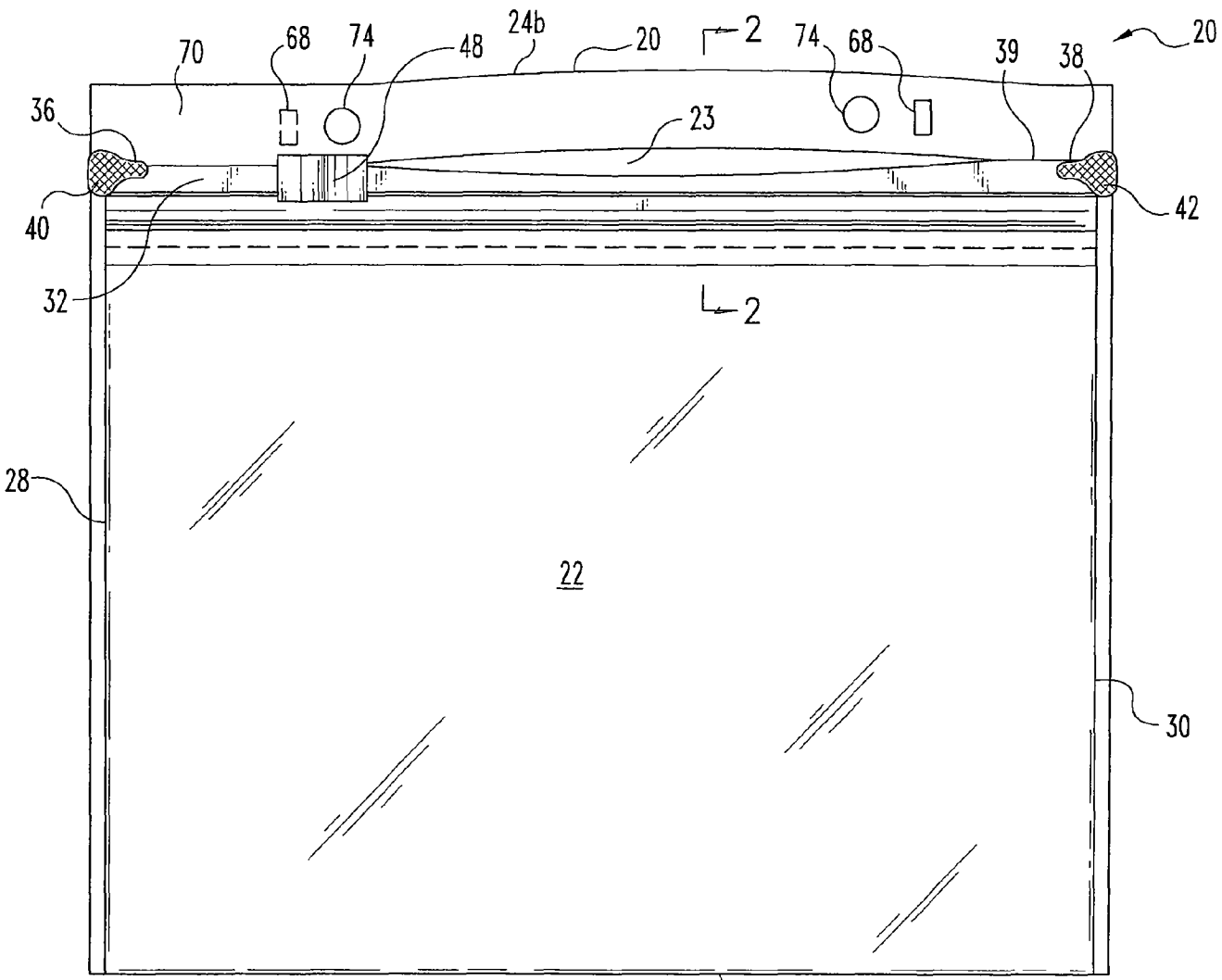
FIG. 1 is a plan side view of a container according to one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

The present invention relates to improvements in flexible reclosable containers, particularly containers which include a header strip for convenient mounting of the container until it is used, and further including a slider for convenient closing of the container while it is used. The header strip is preferably a single-ply flexible material which extends from the mouth of the container. Preferably, the container or the header strip includes a line of weakness, such as by mechanical perforation or laser scoring, to enable a user to easily separate the container from the header strip. In some embodiments, the header strip includes one or more holes through which the header strip and container assembly can be hung from a stand.

In another embodiment, the header strip extends from the mouth of the bag. Further, the mouth of the bag preferably includes a fastener strip along each of the edges of the mouth, each of the fastener strips including an interlockable profile element. A slider is mounted to the fastener strips for easy interlocking and unlocking of the profile elements.

Preferably, the slider and profile elements are arranged and configured such that the mouth of the bag is substantially open. In this manner, it is most convenient for a user of the bag to place his or her hand between the fastener strips and into the bag, tear the bag off of the header strip, and hold the bag for subsequent filling of the container with a product.

As one example, the bag is particularly useful in situations such as a deli counter in a food store, where the store employee uses one hand to tear off the bag from the header strip, and uses the other hand to place a deli counter product in the container with the other hand. This particular arrangement of the header strip extending from an open mouth, preferably with a slider, reduces the motion and time of the store employee to fill the customer's order.

FIG. 1 shows a flexible recloseable container 20 for containing a product, container 20 useful for embodiments in which the container is sold to a consumer in the empty state, although the present invention also contemplates embodiments in which the container includes a product stored therein. Further, some embodiments of the present invention are suitable for use with a form, fill, and seal method of construction, examples of methods for forming, filling, and sealing the flexible recloseable container being found in U.S. Pat. No. 5,956,924, issued Nov. 7, 1997, and incorporated herein by reference.

Container 20 comprises first and second sidewalls 22 and 24, respectively, which may be made from any suitable thermoplastic film such as, for example, low density polyethylene, linear low density polyethylene, or similar materials. Sidewalls 22 and 24 include first left transverse side seal 28 and second right transverse side seal 30. Seals 28 and 30 can be formed by any method, including ultrasonic welding and heat fusion methods. Container 20 also includes a bottom edge 26 generally opposite a pair of interlocking fastener strips 32 and 34. Bottom edge 26 may include a fold between sidewalls 22 and 24, or alternatively edge 26 may include a seal between sidewalls 22 and 24.

Figure 2:
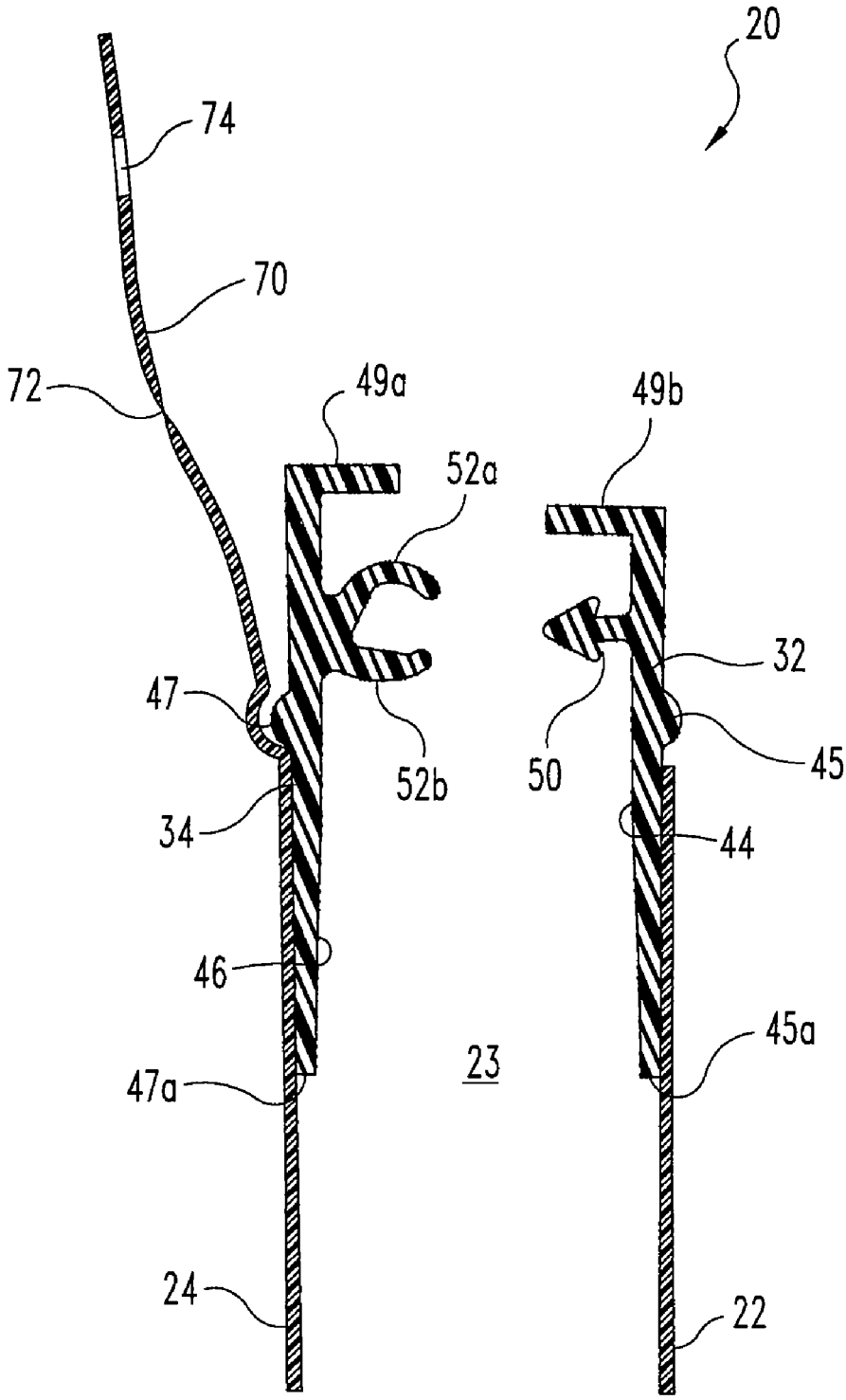
FIG. 2 is a cross-sectional view of the container of FIG. 1 as taken along line 2-2 of FIG. 1.

FIG. 2 is an enlarged cross section of the container of FIG. 1 as taken along line 2-2 of FIG. 1 with sidewall 22 spaced apart from sidewall 24. As shown in both FIGS. 1 and 2, interlocking fastener strips 32 and 34 including one or more interlockable profiles 50, and 52*a* and 52*b*, respectively, run along the top edge or mouth of container 20. Preferably, fastener strips 32 and 34 are fabricated by an extrusion method, although the present invention contemplates any method of fabrication. Fastener strips 32 and 34 can be attached to sidewalls 22 and 24 in any manner, including ultrasonic welding, fusion by heat, or adhesive methods. Strips 32 and 34 are sealed together at endstops 36 and 38. Strips 32 and 34 are sealed to each other and also to sidewalls 22 and 24 at corner seals 40 and 42. Corner seals 40 and 42 are located along their respective edges of container 20. Seals 40 and 42 are generally located below shoulders 45 and 47 of fastener strips 32 and 34, respectively, and above lower edges 45*a* and 47*a* of inner flanges 44 and 46 of fastener strips 32 and 34, respectively.

Figure 3:
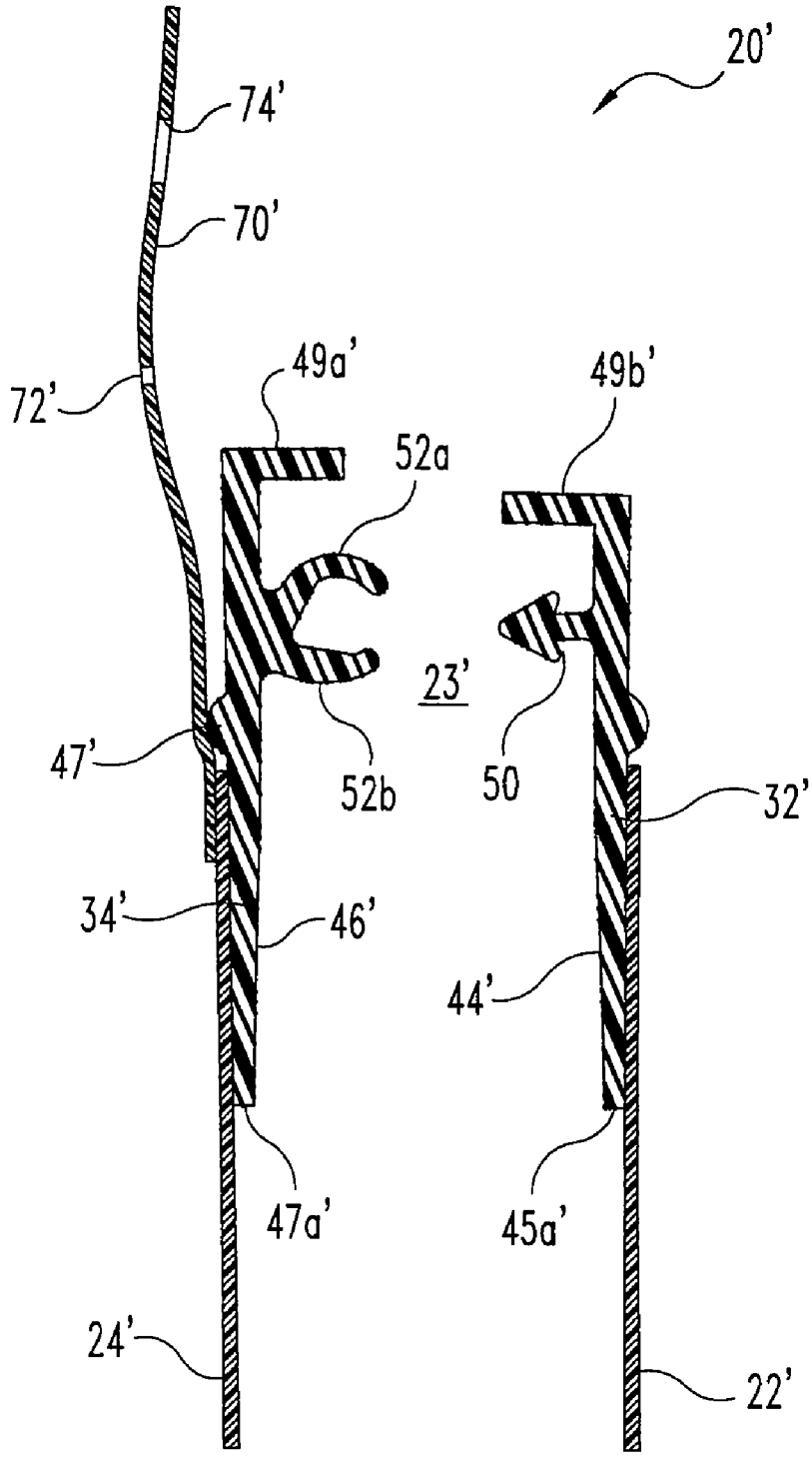
FIG. 3 is a cross-sectional view of a container according another embodiment of the present invention.

In some embodiments of the present invention profiles 50 and 52 are comprised of at least one uppermost and bottommost profile elements. Preferably, one profile element terminates in a shape that can be securely grasped by a complementary-shaped profile element coupled to the opposing sidewall. Referring to FIGS. 2 and 3, apparatus 20 includes a male profile element 50 which interlocks between female profile elements 52*a* and 52*b* of fastener strip 34. These fastener strips and profile elements are further described in U.S. Provisional Patent Applications 60/330,140, filed Oct. 17, 2001, entitled SLIDERS FOR RECLOSEABLE CONTAINERS, incorporated herein by reference. However, the present invention contemplates the use of any type of profile elements compatible with a slider. When fastener strips 32 and 34 are interlocked, cover flanges 49*a* and 49*b* are disposed in overlapping relationship and provide a secondary seal of container 20. As best seen in FIG. 1, a slider 48 straddles and is slidable upon fastener strips 32 and 34. Slider 48 includes a pair of feet (not shown) which retain slider 48 on the interlocking fastener strips by way of shoulders 45 and 47. Further, slider 48 includes a closing end (not shown) which includes a reduced-width aperture which presses the profile elements into interlocking relationship. Slider 48 further includes a separator (not shown) near an opening end which spreads apart and unlocks the profile elements. Movement of slider 48 along the fastener profiles results in either an interlocking of profile elements 50 and 52, or an unlocking of profiles 50 and 52. The present invention contemplates any configuration of slider which locks and unlocks the profile elements, including the sliders, endstops, profiles, docking stations, and other features of a recloseable container disclosed in U.S. patent application Ser. No. 09/794,592, filed Feb. 27, 2001, and incorporated herein by reference.

Some embodiments of the present invention further include a docking station 39 located near endstop 38 and or endstop 36. The docking station provides a location which accommodates the separator element of a slider, and relieves the forces from the separator which would otherwise tend to separate the fastener strips. As one example, the docking station may be formed by placement of the slider adjacent to a heat-fused endstop before the endstop cools. In yet other embodiments, the docking station may be one of a vertical slit, horizontal slit, notch, or window placed in the fastener strips near the corner seals. Additional examples of flexible recloseable containers contemplated by the present invention can be found in U.S. Provisional Patent Application 60/330,140, filed Oct. 17, 2001, entitled SLIDERS FOR RECLOSABLE CONTAINERS, incorporated herein by reference.

In one embodiment of the present invention, container 20 does not include a tamper evident seal. However, in some embodiments of the present invention, container 20 includes a tamper-evident seal between sidewalls 22 and 24. This seal may be an extension of flanges 46 and 44 that extends internally across the opening of container 20. However, the present invention contemplates other configurations of tamper evident seal, including external seals that cover portions of the fastener profiles and slider. The seal may be integrally molded with flanges 44 and 46, or may be attached separately. Further, the seal may be integrally molded with sidewalls 22 and 24 or attached separately. The broken or unbroken state of the seal provides evidence to the user of whether or not the container has been previously opened. A tamper evident seal is especially useful with a form, fill, and seal machine that inserts an edible product into container 20. Further examples of tamper evident seals can be found in U.S. Pat. No. 6,257,763, issued Jul. 10, 2001, and incorporated herein by reference. Yet other forms of laser-scored tamper evident elements are contemplated by the present invention and can be found in U.S. Provisional Patent Application 60/314,787, filed Aug. 24, 2001, entitled SCORED TAMPER EVIDENT ZIPPER SLIDER, and incorporated herein by reference.

FIG. 2 is a close-up cross-sectional view according to one embodiment of the present invention. A header strip 70 extends outwardly from one side of mouth 23. One or more apertures or holes 74 are defined in the upper portion of header 70. Header strip 70 is preferably an integral portion of container side 24, and in one embodiment extends about three inches beyond the end of shorter container side 22. Container side 24 is preferably fused to flange 46 of fastener strip 34 at a location intermediate of fastener strip shoulder 47 and fastener strip bottom edge 47*a*. By locating the attachment below 47*a*, the attachment feet (not shown) of slider 48 are free to move over shoulder 47 without interference by the container sidewall or header strip.

Preferably, a tear line or line of weakness 72 is created along the length of header strip 70 in a direction generally parallel to the edge of mouth 23. This line of weakness can be located along header strip 70 anywhere from hole 74 of header strip 70, to the location where container sidewall 24 is fused to fastener strip 34. The line of weakness 72 can be implemented in any manner, including mechanical scoring or perforation, laser scoring, or any other method.

FIG. 3 depicts a cross-sectional view of another embodiment according to the present invention. The use of a prime (') suffix with an element number (XX') denotes an element that is the same as the element previously cited (XX), except for those changes shown or described hereafter. Header strip 70' is separately attached to profile element 34. Header strip 70' includes one or more apertures or holes 74'. Header strip 70' preferably includes a line of weakness 72' along the length of header strip 70' in a direction generally parallel of the edge of mouth 23'. Header strip 70' is preferably attached by fusion or adhesion at a location below shoulder 47' so as to not interfere with sliding operation of slider 48. Further, the present invention also contemplates those embodiments in which the header strip is integrally extruded with the fastener strip.

Figure 4:
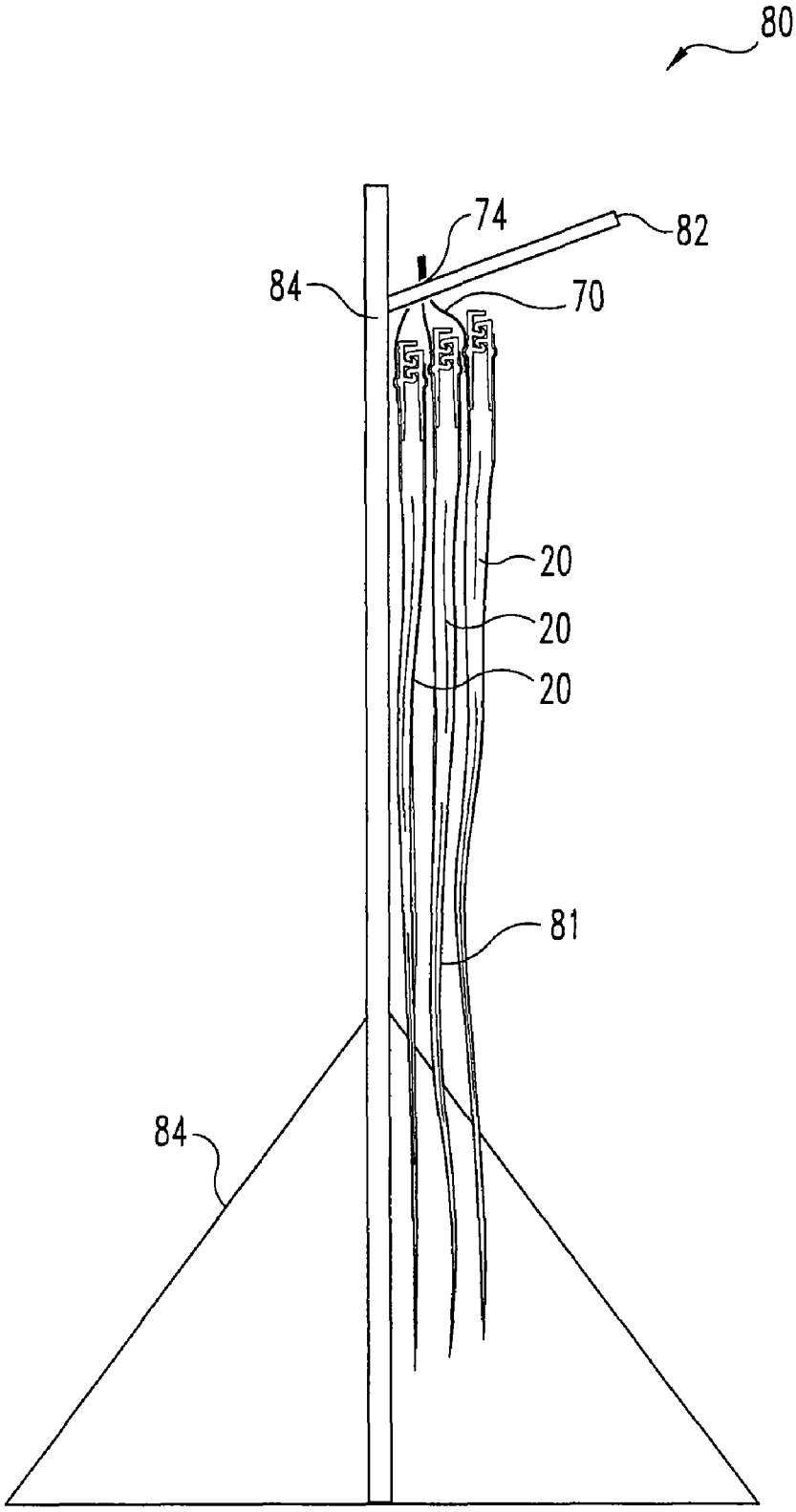
FIG. 4 is a side view of another embodiment of the present invention.

FIG. 4 is a side view of an apparatus 80 according to another embodiment of the present invention. Apparatus 80 includes a plurality of containers 20 which have been attached together into a group 81 by fusing together adjacent portions of the corresponding header strips 70. The header strips are fused or adhered together such that adjacent through holes 74 line up in a manner suitable for mounting container group 81 from a wicket 82. Wicket 82 is preferably supported by a stand 84 such that containers 20 extend downward vertically from wicket 82. Stand 84 is preferably located near the products to be stored in the containers. In yet other embodiments of the present invention, apparatus 80 includes a plurality of containers 20 which have not been attached together into a group, and which instead hang individually from wicket 82.

Figure 5:
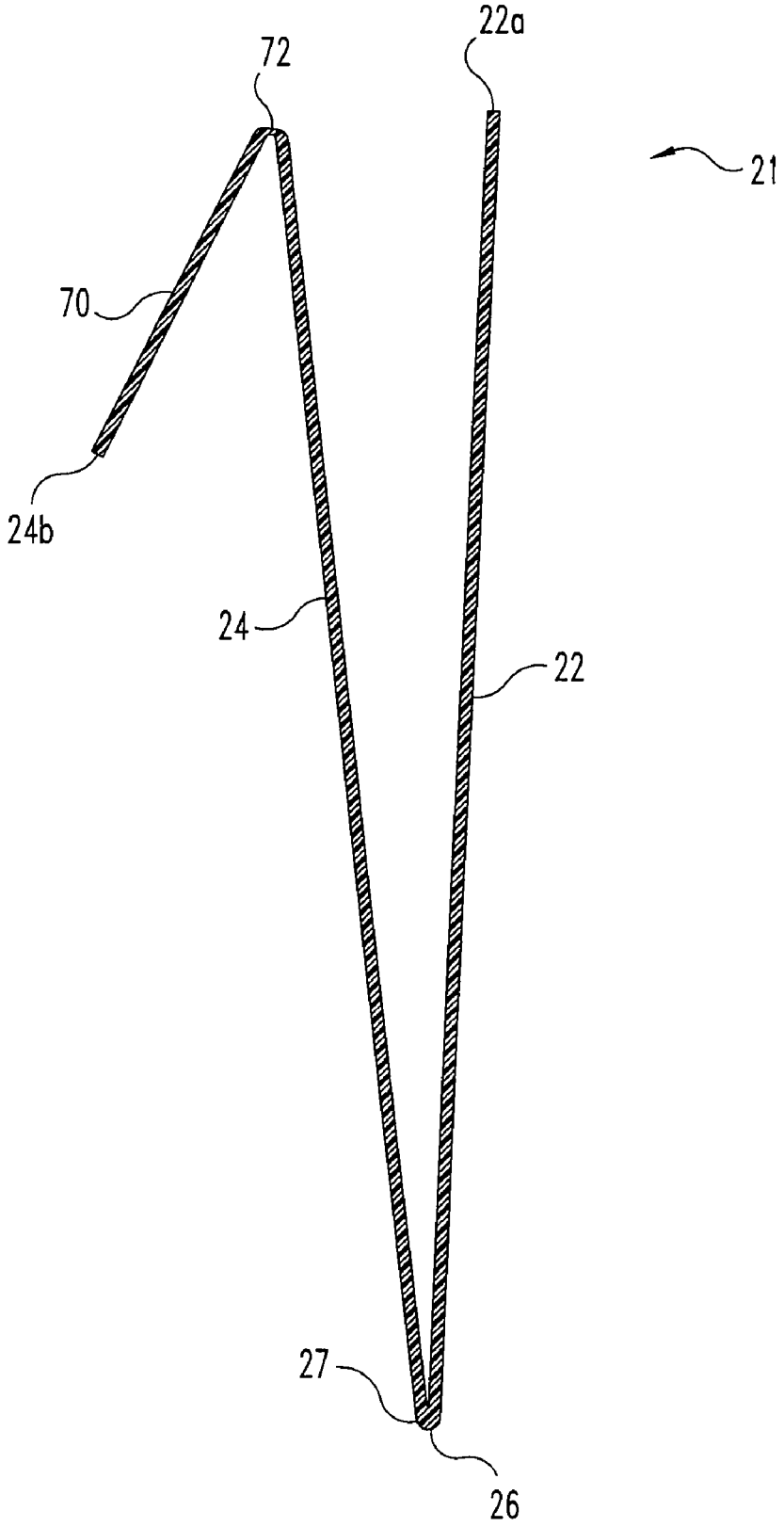
FIG. 5 is side view of a partially constructed container according to another embodiment of the present invention.

FIG. 5 is a side view of a partially constructed container 21 according to another embodiment of the present invention. In this embodiment of the present invention, a sheet 21 is fabricated starting with blown low density polyethylene (LDPE) material, or other material suitable for fabrication of flexible recloseable container. Using a bag machine such as an Amplas MS 1400 Servo machine, the film sheet 21 is folded to include a center fold 27, with one side 24 being about three inches longer than shorter side 22. Line of weakness 72 is created in second side 24 in a manner as previously discussed. Preferably, line of weakness 72 is located approximately opposite free edge 22*a* of shorter side 22. In this embodiment, the length from bottom fold 27 to line of weakness 72 is about the same as the length from bottom fold 27 to free edge 22*a* of shorter side 22. However, the present invention also contemplates those embodiments in which these lengths differ significantly.

After installing line of weakness 72, a folding device folds back a portion 70. This configuration of sheet 21 then enters a fastener attachment machine where a fastener strip is attached along free edge 72, and a second fastener strip is applied proximate to line of weakness 72. Following application of the fastener to sheet 21, slider endstops 40 and 42 are formed, sealed side edges 28 and 23 are formed, and slider 48 is attached to the interlockable fastener strips. However, the present invention can be fabricated using a different sequence of processing. For example, line of weakness 72 can be incorporated after attachment of the fastener strips. Further, slider 48 can be attached to the fastener strips prior to their attachment to sheet 21.

Preferably following attachment of the slider and fastener strips, the folded portion 70 of sheet 21 is folded back out to facilitate the punching of one or more holes 74. In some embodiments, multiple containers 20 are attached together by fusing together adjacent portions of header strips 70. The plurality 81 of fused together containers 20 can then be hung from a wicket 82. Preferably, each slider of a container is placed in a position such that the mouth of the container is substantially open. By having the mouth open, it is convenient for a user to place his or her fingers within the container, tear the container from the wicket along the tear line, and since the container is substantially open, readily place an object in the container.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. An apparatus comprising:

a plurality of bags each having first and second sidewalls defining a mouth with two edges, a bottom, and an interior, said bags being coupled together in a group, said first sidewall being unitary and haying a first length from the bottom to a first free edge that is longer than a second length from the bottom to a second free edge of said second sidewall;

a pair of fastener strips located along each said mouth, said fastener strips including interlockable profile elements for closing said mouth, at least one said fastener strip including a lower edge;

a plurality of sliders, each one of said sliders coupled to the fastener strips of a corresponding one of said bags; and said first sidewall including a header strip for each said bag extending proximate to one edge of the mouth and attached to said one fastener strip at a location intermediate of the profile element and the lower edge of said at least one fastener strip, each said header strip including a line of weakness;

wherein for each said bag said profiles are at least partly unlocked and said mouth is at least partly open, each said bag being configured to allow access to the interior.

2. The apparatus of claim 1 wherein each said slider straddles the corresponding fastener strips.

3. The apparatus of claim 1 wherein each said header strip extends from only one edge of said mouth.

4. The apparatus of claim 1 wherein each said bag does not includes a tamper evident seal extending across the mouth.

5. The apparatus of claim 1 wherein each header strip defines a hole, and the holes of said group are aligned.

6. The apparatus of claim 1 which further comprises a stand for supporting said group in a substantially vertical orientation.

7. The apparatus of claim 1 wherein each said header strip is adapted and configured not to interfere with the movement of said respective slider along said respective fastener strips.

8. The apparatus of claim 7 wherein each said header strip extends from each said respective bag from a position below the bottom of each said respective slider.

9. The apparatus of claim 1 wherein the header strip of each bag is aligned with the header strip of each adjacent bag.

10. The apparatus of claim 9 wherein the header strip of each bag is attached to the header strip of an adjacent bag.

11. The apparatus of claim 1 wherein said header strip has a length that is approximately the difference between said first length and said second length.

12. The apparatus of claim 1 wherein the rear of each bag is adjacent the front of another bag.

13. The apparatus of claim 1 wherein the bottom is a folded bottom.

* * * * *

UNITED STATES PATENT AND TRADEMARK OFFICE

CERTIFICATE OF CORRECTION

PATENT NO. : 8,092,088 B2
APPLICATION NO. : 11/465969
DATED : January 10, 2012
INVENTOR(S) : David W. Keith et al.

It is certified that error appears in the above-identified patent and that said Letters Patent is hereby corrected as shown below:

In the Claims:

At Column 6, in Claim 1, Line 16: please delete “haying” and insert in lieu thereof --having--.

Signed and Sealed this
Eighteenth Day of December, 2012

David J. Kappos

David J. Kappos
*Director of the United States Patent and Trademark Office*